US005465080A

United States Patent [19]

Liddiard et al.

[11] Patent Number: 5,465,080

[45] Date of Patent: Nov. 7, 1995

[54] INFRARED INTRUSION SENSOR

[75] Inventors: Kevin C. Liddiard, Fairview Park; Brian W. Rice, Rostrevor; Rodney J. Watson, Para Hills, all of Australia

[73] Assignee: The Commonwealth of Australia, Canberra, Australia

[21] Appl. No.: 295,857

[22] PCT Filed: Mar. 8, 1993

[86] PCT No.: PCT/AU93/00093

§ 371 Date: Sep. 7, 1994

§ 102(e) Date: Sep. 7, 1994

[87] PCT Pub. No.: WO93/18492

PCT Pub. Date: Sep. 16, 1993

[30] Foreign Application Priority Data

Mar. 9, 1992 [AU] Australia ..... PL1228

[51] Int. Cl.[6] ..... G08B 13/19

[52] U.S. Cl. ..... 340/567; 250/340; 250/395

[58] Field of Search ..... 340/567; 250/340, 250/395

[56] References Cited

U.S. PATENT DOCUMENTS

| | | | |
|---|---|---|---|
| 3,475,608 | 10/1969 | Pardes | 250/334 |
| 3,524,180 | 8/1970 | Cruse | 340/567 |
| 3,912,927 | 10/1975 | Hoffman, II | 250/234 |
| 5,101,194 | 3/1992 | Sheffer | 340/567 |
| 5,299,971 | 4/1994 | Hart | 340/567 |

FOREIGN PATENT DOCUMENTS

| | | |
|---|---|---|
| 7584281 | 4/1982 | Australia . |
| 4359885 | 12/1985 | Australia . |
| 4609285 | 2/1986 | Australia . |
| 005972 | 12/1979 | European Pat. Off. . |
| 408980 | 1/1991 | European Pat. Off. . |
| 1466518 | 3/1977 | United Kingdom . |

*Primary Examiner*—Glen Swann III

*Attorney, Agent, or Firm*—Marshall & Melhorn

[57] ABSTRACT

An infrared intrusion sensor includes an array of infrared detectors, infrared collection optics, a focal plane scanning device having a dither adapted to repetitively scan the infrared radiation across the detector array, signal process devices, and local or remote displays. The sensor incorporates heterodyne detection techniques with a local oscillator signal derived from the scanning frequency of the focal plane scanning device. The sensor has a low false alarm rate and enhanced detection range. A method of processing the signals includes analog to digital conversion, integration of the digital signals to produce a background signal, phase sensitive detection of the digital signal producing a target signal, and comparison of the background and target signals producing a difference signal. The difference signal is integrated to produce a background noise signal and processed to become a threshold signal which is finally compared to the difference signal to produce an alarm signal.

15 Claims, 4 Drawing Sheets

INFRARED INTRUSION SENSOR

BACKGROUND OF THE INVENTION

This invention relates to an infrared intrusion sensor. In particular, the invention relates to an infrared intrusion sensor which is a long range passive detection system designed for remote unattended surveillance applications. The invention is expected to find applications in airfield perimeter security, high grade fence line security, vital asset protection and other surveillance environments.

The sensor differs from other infrared intrusion sensors in that it has a superior detection range compared to existing devices. Furthermore it provides more extensive information to the operator. For example, the invention has the capability of indicating the direction of movement of a target, number of targets, false alarm probability, near/far field indication, and failure/tamper indication.

In one existing device designed for military use the useable range is 30 metres although the optimum detection range is stated to be 6 metres. This device is admitted to have difficulties with slow-moving targets between 15 metres and 30 metres. In another military device the stated detection ranges are 3 to 20 metres for personnel and 3 to 50 metres for vehicles.

Domestic intrusion sensors have a typical detection range of less than 20 metres. One known civilian security sensor has a detection range of 100 meters but only provides a simple alarm.

These existing intrusion sensors have technical limitations, the major limitation being the relatively short range capabilities of these devices and unacceptably high false alarm rates. Most existing sensors are not capable of indicating the direction of target movement, or if they can indicate the direction of movement it is at the expense of other facilities.

It is an object of this invention to provide an infrared intrusion sensor having enhanced detection range and low false alarm rate compared to existing devices.

It is a further object of this invention to alleviate one or more of the above mentioned problems or at least provide the public with a useful alternative.

SUMMARY OF THE INVENTION

Therefore, according to one form of this invention, there is proposed an infrared intrusion sensor comprising:

- an infrared detector array adapted to provide a signal indicative of infrared radiation impinging upon the detector;
- infrared collection optics adapted to collect and direct infrared radiation to the detector array;
- dither means adapted to repetitively scan the infrared radiation across the detector array;
- signal processing means adapted to analyse the detector signal and produce output alarm signals; and
- output display means adapted to display the output alarm signals.

The device operates by passively monitoring the thermal radiation emitted in the 8 μm to 13 μm range from a narrow sector in front of the device. When a body having a thermal signature different to that of the background (ie. a person) passes through the monitored region, its thermal (infrared) radiation is detected. Infrared radiation arriving from the scene is optically modulated, then focussed onto a thin film bolometer detector array operated at ambient temperature. The detected signal is amplified and digitised. Digital signal processing is accomplished with an onboard microprocessor, which can be pre-programmed or directly accessed by the operator. The scene background within the sensor field of view is stored over a preset integration period and regularly updated. Targets are detected as differential signals referenced to the background. This technique ensures a low false alarm rate. In particular the sensor will not respond to background variations which are a source of frequent false alarms in other intrusion sensor equipments.

In preference the optics comprise a Cassegrain style objective telescope and infrared transmitting entrance window. The Cassegrain-style telescope is formed by a primary mirror and a smaller secondary mirror mounted on the dither means. The entrance window provides protection against damage to the internal optics of the device. The window is preferably a material such as germanium to permit transmission of the radiation band of interest between 8 μm and 13 μm. Optional materials include zinc sulphide, zinc selenide, silicon and infrared transmitting plastics.

In preference the infrared transmitting window has a hard carbon coating on an outer surface to provide protection against scratching or other damage and an antireflection coating on the inner surface.

It has been found advantageous to operate the Cassegrain telescope with a correction lens just prior to the detector. This catadioptic arrangement provides improved optical resolution and enables the detector array to be located behind the primary mirror.

In preference the dither means is a focal plane scanning device having a mirror pivoted to nod driven by at least one of a pair of piezoceramic drive elements arranged generally parallel to the plane of the mirror. Such a device has been previously described by one of the inventors in Australian Patent number AU 571334 and corresponding U.S. Pat. No. 4,708,420. In conjunction with the Cassegrain telescope the focal plane detector array allows the device to achieve a smaller instantaneous field of view than would otherwise be possible with a small number of larger detectors.

In preference the detector consists of a focal plane array of metal film bolometer detectors, In one form of the invention there are 16 detector elements arranged in two adjacent columns of eight. In another form there are twenty arranged as a linear array. Other arrangements are possible and the invention is not limited to any one arrangement.

A suitable metal film bolometer detector is that described by one of the inventors in Australian Patent number AU 537314 and corresponding U.S. Pat. No. 4,574,263. The method of producing a detector and an array of detectors suitable for the intrusion sensor is described in the patent.

In preference the detector is a heterodyne detector with the local oscillator signal being the scanning frequency of the dither means. A phase locked loop provides the scanning frequency of the dither element as well as the local oscillator signal for the heterodyne detection. Heterodyne detection gives considerable advantages in achieving good signal to noise ratios. The dither means provides a low frequency oscillation which moves the detected signal away from zero Hertz and therefore avoids 1/f noise problems.

Associated analogue electronics include an amplifiedfilter for each detector element. The detected analogue signals are then routed to a signal processing means.

In preference the signal processing means is comprised of:

- an analogue-to-digital converter adapted to convert analogue signals received from the detector to digital signals;

digital signal processing module adapted to analyse the digital signals to produce output signals; and memory means adapted to provide temporary storage of information.

An optional analogue signal processing technique is described by one of the inventors in Australian Patent number AU 575194.

The analogue signals from the detectors are directed to the analogue to digital converter for conversion to digital form. The digital signals are processed in a digital signal processor to produce output alarm signals.

The output alarm signal options include:

Target detection

Target direction of movement

Near/far field indication

Sensor identification

Failure/tamper indication

Detection probability

In the absence of real targets detector signals originating from the variations in the ambient background scene are integrated over time to produce a measure of the background which is stored in the memory means. In one form the memory means is random access memory (RAM) although other forms of memory could be used.

In preference the digital signal processing module consists of a processor means and a program memory means and performs digital signal processing comprising the steps of:

integration over time to produce a background signal;

phase sensitive detection to produce a target signal;

comparison between the target signal and the background signal to produce a difference signal;

a second integration over time to produce a background noise signal;

processing of the background noise signal to produce a threshold signal; and comparison of the difference signal with the threshold signal to produce an alarm signal.

In preference the target signal is derived from the detector signal by phase sensitive detection at the scanning frequency of the dither means. The phase sensitive detection is preferably band-limited to reduce noise. The band limit is determined by the maximum anticipated target speed and in preference can be set by the operator.

In preference detected fluctuations in the scene background are integrated over time to produce a background signal. The integration time is preferably determined by the minimum anticipated target speed versus the rate of change of the background over time and preferably can be set by the operator. Typical values are in the range 1 second to 30 seconds.

In preference a difference signal is generated by subtracting the background signal from the target signal. The difference signal in the absence of a real target is integrated over time to produce a background noise signal. The integration time is determined by a false alarm rate versus thermal scene stability and can preferably be set by the operator. Typical values are in range 1 second to 1 minute.

In preference the background noise signal is processed to produce a threshold signal. The processing preferably consists of multiplying the background noise signal by an alarm threshold factor. The alarm threshold factor may be statistically derived as one tenth increments which can preferably be set by the operator. Typical values of the alarm threshold factor are in the range 1 to 9.9.

In preference the alarm signal is produced if the difference signal is greater than the threshold signal. The duration of the alarm signal is preferably set by the operator. Typical values are from 1 second to 10 seconds.

Additional outputs from the digital signal processor may include:

Status summary

On-line assistance

Unit identification number

Display state (local or remote)

Number of current alarmed channels

Channel status

ADC output

In addition the analysis means provides Initial Built in Test (IBIT) and Periodic Built in Test (PBIT) capabilities. An indication of battery voltage may also be provided by way of a liquid crystal or other suitable indicator.

An IBIT is initiated at power on. The result of the IBIT is one of either fully operational, impaired operation (one failed detector channel), or total failure. The result is displayed at the display means.

The PBIT monitors each channels integrity and suppresses any channel that becomes unreliable. This would occur if, for example, the channel noise fell outside a specified range indicating channel failure.

In preference the display means may be either local or remote. Local display is provided at the device. This may be in the form of visible signals provided by light emitting diodes, audible signals provided via headphones or a small solid state speaker or tactile signals provided by a small vibrator. The local display also provides a facility for a local check of the IBIT results.

Alternatively the display may be provided remotely. In this case the remote link may be via radio link or ground line. A serial data link interface is provided for remote operation. This can conveniently be an RS232 standard serial interface although other interfaces are possible and would fall within the scope of the invention.

The serial interface may also be used for reprogramming of the digital signal processor. The following parameters may be routinely changed via the remote interface:

Alarm thresholds

Alarm threshold factor

Filter bandwidth

Integration time

Local display output control

Unreliable channel suppression

In a further form there is proposed a wide area surveillance apparatus comprising:

a plurality of infrared intrusion sensors each sensor comprising an infrared detector array adapted to provide a signal indicative of infrared radiation impinging upon the detector; infrared collection optics adapted to collect and direct infrared radiation to the detector array; dither means adapted to repetitively scan the infrared radiation across the detector array; and signal processing means adapted to analyse the detector signal and produce output alarm signals;

network control means adapted to receive output alarm signals from each sensor; and network display means adapted to display the output alarm signals.

In this arrangement a number of infrared intrusion sensors are preferably controlled from a central location by the network control means. Control may be via radio link or landline. The network control means may incorporate a stand alone computer such as a commercially available personal computer. Alternatively, the sensors may be integrated with an existing remote surveillance or security sensor system.

In preference the network control means comprises a computer and network controller. The network controller interlaces between the plurality of infrared intrusion sensors and a serial port of the computer. In this arrangement the computer may also comprise the network display means.

Other sensors, such as seismic sensors, may also be linked to the network.

BRIEF DESCRIPTION OF THE DRAWINGS

For a better understanding of this invention a preferred embodiment will now be described with reference to the attached drawings in which:

FIG. 6 is a flowchad of the signal processing algorithm.

DESCRIPTION OF THE PREFERRED EMBODIMENT

Figure 1:
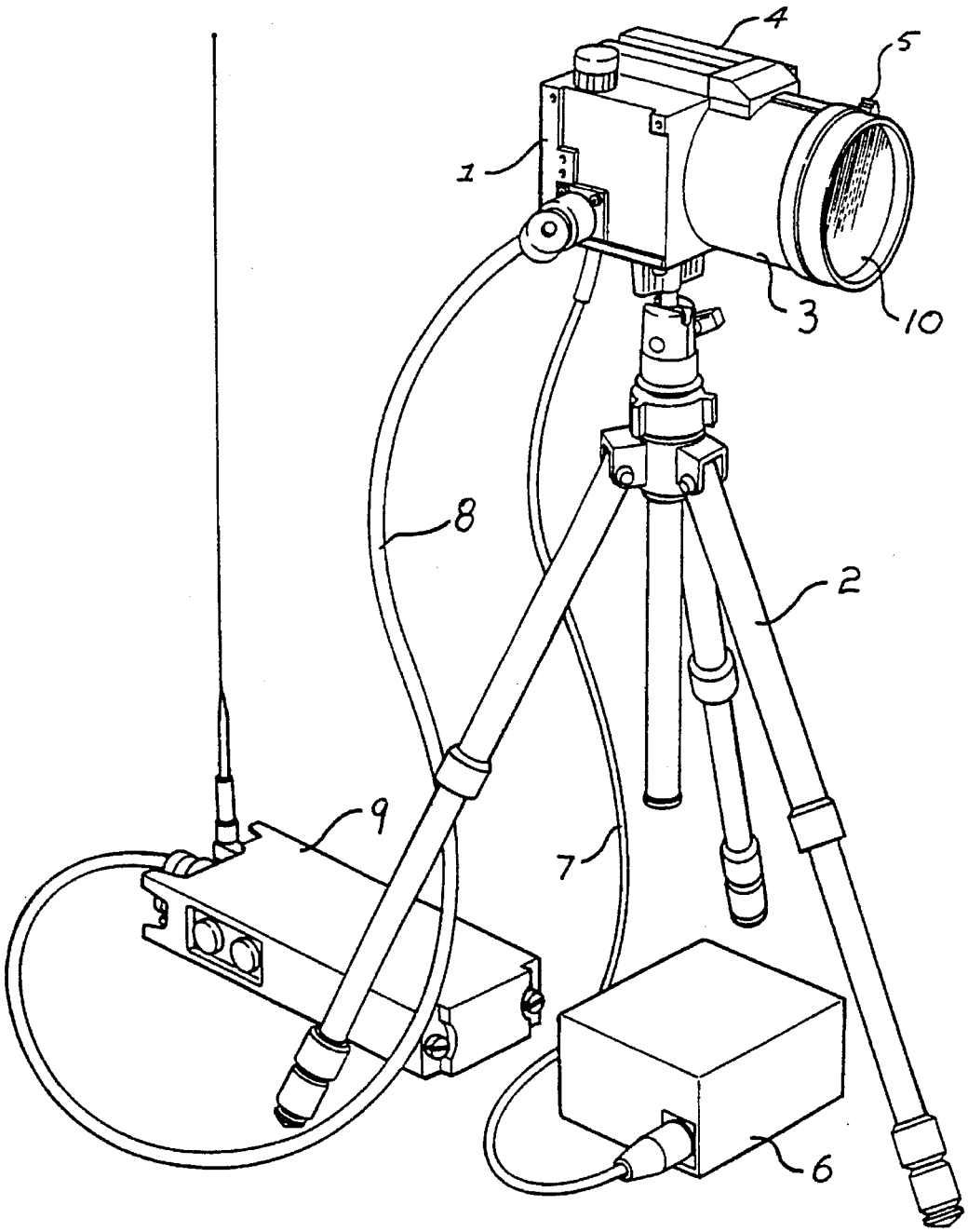
FIG. 1 shows an outline of the invention in isometric view.

Turning now to the drawings in detail. In FIG. 1 there is shown a schematic of a first embodiment of an infrared intrusion sensor 1 mounted on a tripod 2. The sensor comprises an optics housing 3 and an electronics box 4 containing the analogue and digital electronics. There is provided an iron sight 5 to aid in accurate positioning of the intrusion sensor 1. As an option there can be provided an optical sight unit similar to that commonly used on firearms.

Power for the sensor is provided through umbilical 7 by power supply 6 which is detached from the rest of the sensor 1. In an alternative embodiment the power supply may be removably attached to the sensor 1. Display means is provided in the form of light emitting diodes (not shown) on the sensor 1.

Referring again to the first embodiment, for remote operation the local display is replaced by a radio transmitter 9 connected to the sensor 1 by umbilical 8. The intrusion sensor 1 and transmitter 9 may then be setup for unattended operation. The umbilical 8 also contains input lines which can be utilised for programming of a digital signal processor contained in the electronics. box 4.

Figure 2:
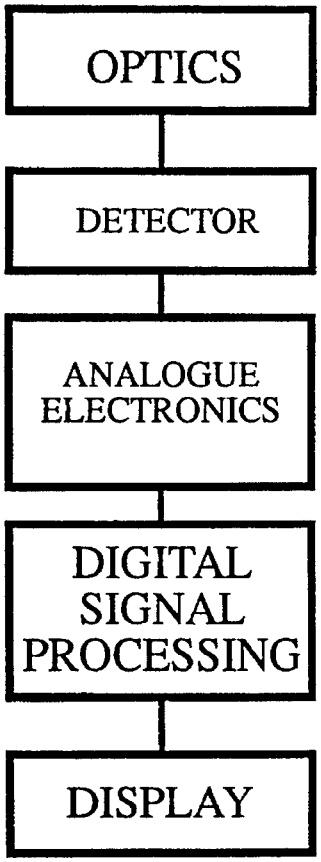
FIG. 2 is a block diagram of the invention.

FIG. 2 shows a block diagram of the invention identifying the major functional units which are described in more detail below.

Figure 3:
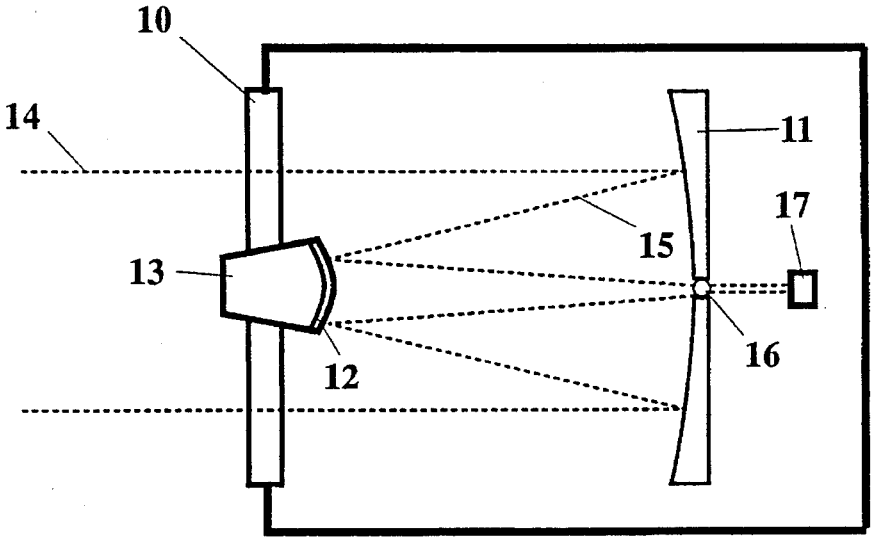
FIG. 3 is a schematic of the detector and optics of the invention.

FIG. 3 schematically shows the optics contained in the optics housing 3. There is an input window 10 made of germanium which transmits radiation in the 8 μm to 13 μm range. The window provides protection from damage for the internal optics. The window has a hard carbon coating on the outside surface and a anti-reflection coating on the inside surface. The hard carbon and antireflection coatings are optimised for the 8 μm to 13 μm radiation band. The internal optics consist of a Cassegrain-style telescope comprised of a primary mirror 11 and a secondary mirror 12. The secondary mirror 12 is mounted on a dither means 13. The combination of the telescope and the dither means comprises a focal plane scanning device.

Radiation emitted by a body in the field of view enters the sensor 1 via window 10 as shown by rays 14. The radiation is reflected by the primary mirror 11 onto the secondary mirror 12 as shown by rays 15. The secondary mirror reflects the radiation on to lens 16 which focuses the radiation onto the detector array 17. The lens 16 is provided with an anti-reflection coating on both sides to maximise transmission.

Figure 4:
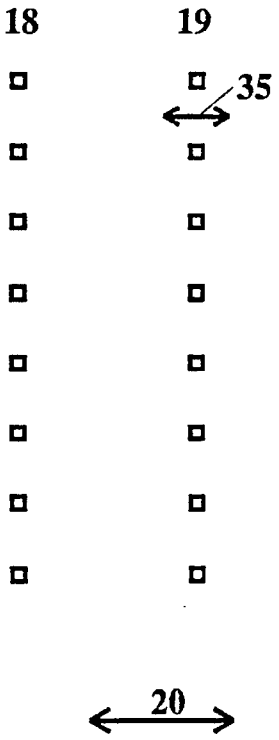
FIG. 4 is a schematic of the detector array showing the direction of dither of the dither means.

The detector 17 is formed from two adjacent columns 18, 19 each of eight elements as shown in FIG. 4. Each element is a metal film bolometer comprised of a thin film of platinum deposited on a dielectric pellicle over a silicon substrate. Each element is approximately 0.07 mm square and there is 1.0 mm between columns and 0.4 mm between rows. This arrangement of detector elements, in conjunction with the optical system, determines the overall field of view and optical resolution of the intrusion sensor. Those skilled in the art will appreciate that other detector arrays and optical arrangements may also be employed.

Radiation falling upon each detector element generates a change in the static bias current which is carried by electrical contacts bonded to each detector. The small electrical signal is amplified by low noise amplifiers to a level sufficient for analogue to digital conversion.

The direction of dither relative to the detector array is shown by arrow 20. In the preferred embodiment the dither range is 0.35 mm peak to peak as indicated by arrow 35. The effective detector size at the focal plane is a rectangle five times as long as wide. Other scan formats are possible, for example, the dither may be executed along the axis of a linear array of detector elements.

Figure 5:
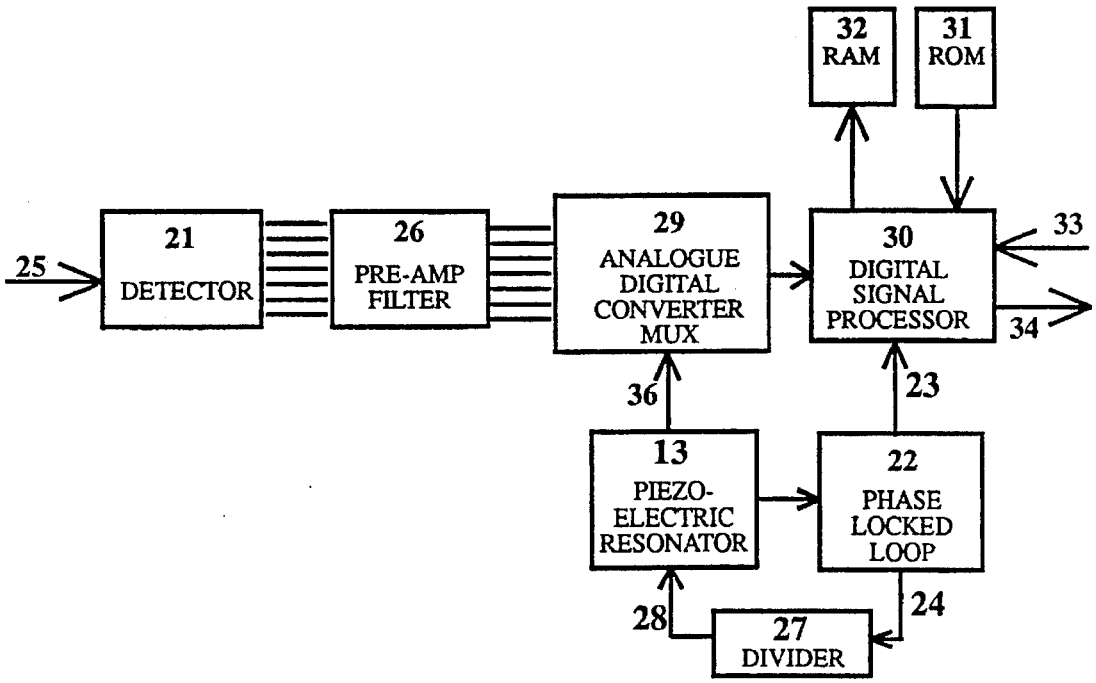
FIG. 5 is a block diagram of the signal processing electronics.
Figure 9:
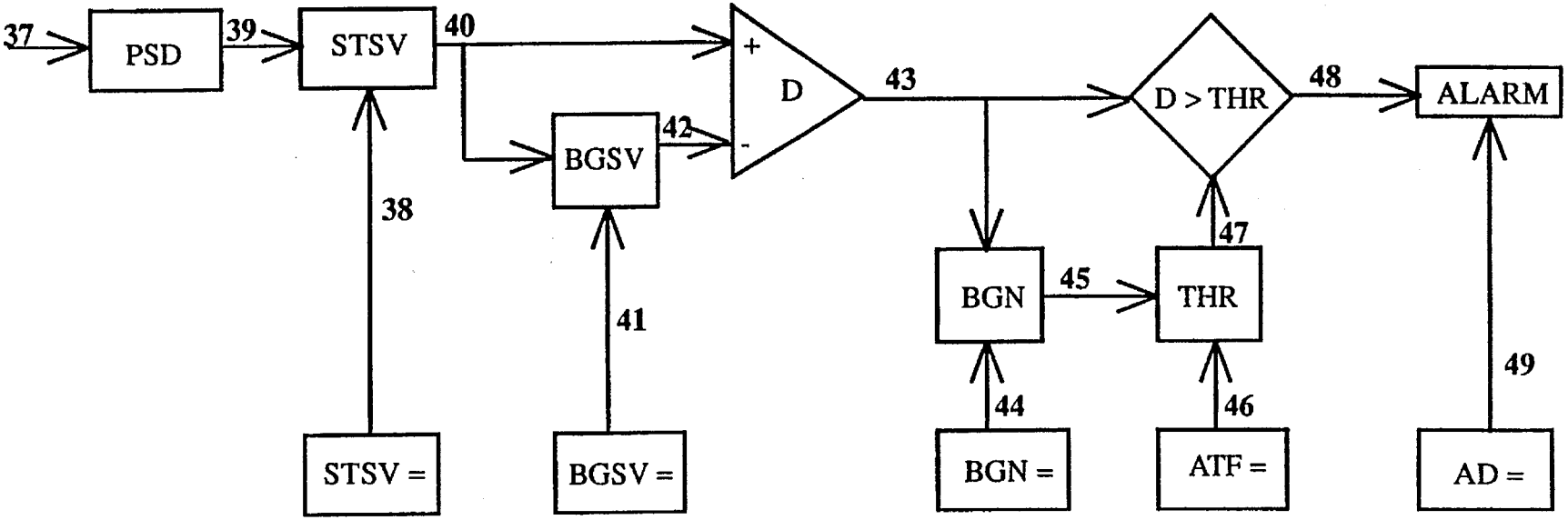

FIG. 5 shows schematically the electronics of the intrusion sensor. The metal film bolometer detector 21 is operated using a heterodyne technique. The signal from each detector element is amplified in preamplifier 26 before going to an analogue to digital converter 29. A phase locked loop 22 operating at 1600 Hz provides a synchronisation signal 23 to the digital signal processor 30. The phase locked loop 22 also provides a signal 24 to a divider 27 which divides the phase locked loop signal to 100 Hz to drive the dither means 13. A signal 36 from the dither means 13 is provided to the analogue to digital converter multiplexer 29 for synchronisation of the ADC process. In this way the radiation 25 impinging upon each detector element is oscillated at the dither frequency and detected using heterodyne techniques, noise problems associated with detecting a DC signal are thus avoided.

The digital signals are then processed in a digital signal processor 30. The algorithms used by the digital signal processor are contained in a ROM or EPROM 31. Temporary memory storage for the integrated background level is provided by a RAM 32. The digital signal processor has various inputs 33 and outputs 34 described below.

FIG. 6 shows the signal processing method displayed schematically as a flowchart. In FIG. 6 the following abbreviations apply:

STSV = Short Term Signal Vector

PSD = Phase Sensitive Detector

BGSV = Background Signal Vector

BGN = Background Noise

THR = Threshold

ATF = Alarm Threshold Factor

AD = Alarm Duration

The method can be conveniently implemented as a program for a microprocessor. A listing of one such implementation is included as Table 1.

Referring to the flowchart of FIG. 6 a channel signal from the analogue to digital converter enters the digital signal processor at 37. Phase sensitive detection PSD is used to obtain the signal component at 100 Hz, which is the dither frequency in this embodiment. The signal is band-limited to reduce noise with the system bandwidth being adjusted 38 using the STSV=command. The acceptable input values are integers from 0 to 9 which correspond to ten preset values in the range 2–32 Hz.

The signal 40 is integrated over time to produce a background signal BGSV. The background signal integration time can be adjusted 41 with the BGSV= command. The acceptable input values are integers from 0 to 9 which correspond to ten preset values in the range 1–30 seconds. The output 42 from BGSV and the output 40 from the PSD are compared in comparator D which produces the difference value STSV-BGSV 43.

The signal 43 is integrated over time to produce a background noise value BGN. The background noise integration time can be adjusted 44 using the BGN=command. The acceptable input values are integers from 0 to 9 which correspond to ten preset values in the range 1 second to 1 minute. A threshold value THR is determined as BGN times ATF. ATF is the alarm threshold factor which can be adjusted 46 with the ATF=command. The acceptable input values are integers from 1 to 9.9.

The resultant signal 47 is compared to the difference signal 43. If the difference signal is greater than the threshold an alarm signal 48 is generated. The duration of the alarm signal may be adjusted 49 with the AD=command which may take the values from 0 to 10 corresponding to seconds of alarm duration.

The command software supports a number of other input and output commands. Those skilled in the relevant art will be aware of the nature of commands which are possible. The commands and functions described herein are indicative of the nature of the software embodiment of the method of operation but should not be understood as limiting the scope of the invention.

Furthermore, the method of signal processing is not restricted to phase sensitive detection of the fundamental dither scan frequency. Detection of positive and negative going signals during target detection can be utilised to further reduce false alarms.

In a further embodiment both the fundamental and first harmonic of the dither frequency can be employed. This further enhances signal detection and enabled dual bandwidth utilisation for simultaneous detection of slow and fast moving targets.

The device described herein has a maximum detection range in excess of 500 m for personnel and vehicles. The nominal detection range is 250 m for 100% detection probability. The improved range performance over existing devices is due to the combined effects of the detector, optics and software.

Throughout this specification the purpose has been to illustrate the invention and not to limit this.

Table 1

```
]FServiceScanSyncInt equ  @LCV(R)
        global  FServiceScanSyncInt

; Start of Interrupt code
        bclr   #4,x:PortBDataRegister        ; enable the adc prove !CS
        movep  #0,x:<<SSIDataRegister        ; channel address 0

]SaveProcessorState
; We only need to push registers that are used!

        move   #YRegisterSaveArea,r7     ; Save processor state
        nop                              ; r7 not available!

        move   r1,y:(r7)+
        move   r2,y:(r7)+
        move   r3,y:(r7)+
        move   r4,y:(r7)+
        move   r5,y:(r7)+

        move   n1,y:(r7)+
        move   n2,y:(r7)+
        move   n3,y:(r7)+
        move   n4,y:(r7)+
        move   n5,y:(r7)+

        move   x0,y:(r7)+
        move   x1,y:(r7)+
        move   y0,y:(r7)+
        move   y1,y:(r7)+
        move   a0,y:(r7)+
        move   a1,y:(r7)+
        move   a2,y:(r7)+
        move   b0,y:(r7)+
        move   b1,y:(r7)+
        move   b2,y:(r7)+ ; leave r7 alone - serves as pseudo stack pointer

]UpdateCounters
        move   #>$1,x0              ; increment heart beat counter
        move   y:YScanCount,a
        add    x0,a
        move   #>$3fffff,x0
```

```
        and     x0,a
        move    a1,y:YScanCount
        move    #$080000,x0
        move    x0,x:YChannelMask

]RestoreVariables
        move    y:YLutOffset,r2      ; fetch the LUT table offset (phase)
        move    y:YLutBase,n2        ; fetch LUT base pointer
        move    #0,r1                ; Indexing register points to channel 0

;   Signal Generation.
;       The following block of code generates 'waveforms' for use in timing
;       control of the iris components. Most notable is the generation of a
;       TwoHz variable duty cycle square wave that is used to flash the LEDs.

        clr     a                    ; Looking for 100hz transition
        move    y:YLutOffset,a
        tst     a
        jne     LoopStart             ; No signal generation this irqa

        bchg    #2,y:YSignalGenerator ; 100hz transition

        move    y:YFiveSecondCount,a1  ; 5 second periodic led flash
        move    #>1,x0
        sub     x0,a
        jne     UpdateFiveSecCount
        move    #>500,a


]UpdateFiveSecCount
        move    a,y:YFiveSecondCount
        jne     TwoHz                ; using previous tst (a always != 0 here)


        ; Set up led flash if no alarms
        move    y:YLeftAlarmRemaining,a
        tst     a
        jne     TwoHz                ; Left LED is on - no periodic

        move     y:YRightAlarmRemaining,a
        tst      a
        jne      TwoHz

        ; No alarms and time for periodic flash
;        move     #>50,x0
;        move     x0,y:YLeftAlarmRemaining
;        move     x0,y:YRightAlarmRemaining


]TwoHz
        move    y:YTwoHzCount,a
        move    #>1,x0
        sub     x0,a
        jne     UpdateTwoHzCount
        bchg    #1,y:YSignalGenerator
        move    #>50,a               ; This constant determines the flash rate


]UpdateTwoHzCount
        move    a,y:YTwoHzCount

]LedAlarms                          ; Indicate alarms on the local LEDs
                                   ; Racal classic alarms to be handled
                                   ; in the main program loop (simple on/off)
```

```
; Before displaying any alarms check that the YLocalDisplayEnable option
; is set.

        move    y:YLocalDisplayEnable,a
        tst     a
        jeq     NoLocalDisplay          ; No local LED display

]LeftLED
        move    y:YLeftAlarmRemaining,a
        tst     a
        jeq     LeftLEDOff      ;.YLeftAlarmRemaining is 0 - don't decrement
        move    #>1,x0
        sub     x0,a
        move    a,y:YLeftAlarmRemaining
        bset    #1,x:<<PortBDataRegister  ; Turn the left LED off
        jeq     RightLED                  ; If YLeftAlarmRemaining has become 0
                                          ; otherwise flash LED using 2Hz
;       btst    #1,y:YSignalGenerator     ; should LED be on or off?
;       jcc     LeftLEDOff
        bclr    #1,x:<<PortBDataRegister  ; Turn LED on

]LeftLEDOff
]RightLED
        clr     a
        move    y:YRightAlarmRemaining,a
        tst     a
        jeq     RightLEDOff     ; YRightAlarmRemaining is 0 - don't decrement
        move    #>1,x0
        sub     x0,a
        move    a,y:YRightAlarmRemaining
        bset    #0,x:<<PortBDataRegister  ; Turn the left LED off
        jeq     LoopStart                 ; If YRightAlarmRemaining has become 0
                                          ; otherwise flash LED using 2Hz
;       btst    #1,y:YSignalGenerator     ; should LED be on or off?
;       jcc     RightLEDOff
        bclr    #0,x:<<PortBDataRegister  ; Turn LED on

]RightLEDOff
]NoLocalDisplay
]LoopStart                          ; Top of proceesing loop

        do      #16,EndLoop         ; for all 16 channels do the following

        ; The conversion time is accounted for
        ; in the code below (the rest of the
        ; calculations)
        ;* Conversion time for channel 0 is
        ; accounted for by the initial preamble

]WaitADC                    ; ensure conversion completed
        btst    #7,x:<<SSIStatusRegister
        jcc     WaitADC

        move    x:YChannelMask,b1   ; Calculate next channel to convert
        move    #>$080000,x0        ; increment in bit position
        add     x0,b
        move    b1,x:YChannelMask   ; saved for next time
                                    ; NOTE: The above code issues an extra
                                    ; ADC command to read channel 16
        movep   b1,x:<<SSIDataRegister    ; Initiate next conversion


        movep   x:<<SSIDataRegister,a1  ; read the adc value for channel r1
```

```
        move    #0,a2
        move    #0,a0
;clr a


        move    #$7fffff,b          ; .999999
        sub     b,a
        move    a1,y0

;   Calculate Cross Product
;       On entry:
;             y:(r2+n2) is the current phase value from the LUT
;             a         is the A/D value

]Cross
        move    y:(r2+n2),x0          ; x0 = LUT value
        mpy     x0,y0,b    #YStSv1,n1 ; b contains Cross for channel r1
                                      ; n1 points to StSv (t-1) hi 24 bits


;   Calculate StSv
;   On entry r1 is the offset into the parameter storage arrays
;   for the channel number currently being processed.

]StSv
        clr     a
        move    x:(r1+n),a1           ; StSv(t-1) (hi 24 bits) -> a1
        move    a1,x0                 ; 24 bits (hi) of StSv(t-1)
        move    #YStSv0,n1            ; n1 points to hi 24 bits StSv(t-1)
        move    y:YStSvA,y0           ; y0 = (1-a) for StSv
        move    x:(r1+n),a0           ; StSv(t-1) (lo 24 bits) -> a0
        mac     -x0,y0,a              ; a -= (StSv(t-1) * (1-a))
        move    b1,x0                 ; x0 = cross product
        move    #YStSv1,n1            ; n1 points to StSv hi 24 bits
        mac     x0,y0,a               ; a = (1-a)Cross + ^^^^^^
        move    a1,x:(r1+n)           ; save hi 24 bits for next time
        move    #YStSv0,n1            ; n1 points to hi 24 bits StSv
        nop
        move    a0,x:(r1+n)           ; save low 24 bits for next time

;   Calculate BgSv

]BgSv
        move    #YBgSv1,n1            ; fetch BgSv(t-1)
        move    y:YBgSvA,y0           ; y0 = (1-a) for BgSv
        move    x:(r1+n),a1
        move    #YBgSv0,n1
        move    a1,x0                 ; x0 = BgSv(t-1) 24 bits
        move    x:(r1+n),a0
        mac     -x0,y0,a              ; a += (BgSv(t-1) * (1-a)
        move    b1,x0
        mac     x0,y0,a  #YBgSv1,n1
        nop
        move    a1,x:(r1+n)

        move    #YBgSv0,n1
        nop
        move    a0,x:(r1+n)        ; Can we r1+ here and simplify next block?

]ADCLoop
        btst    #7,x:<<SSIStatusRegister     ; bit copied to carry flag !!!!
        jcc     ADCLoop

;   Have we finished all channels?
```

```
        move    #>1,x0
        move    r1,a
        add     x0,a
        move    a,r1                    ; r1 now points to next channel
]EndLoop

;       Intruder and Bgn are decimated and thus calculated at 100hz.
;       This is derived from the LUTOffset r2.

;   Calculate Intruder
;   Note: can't use a or b contents as they will always be for channel 15!

]Intruder
        clr     b   #YStSv0,n2          ; load b with StSv[r2] (48 bits)
        nop
        move    x:(r2+n),b0
        clr     a   #YStSv1,n2
        nop
        move    x:(r2+n),b
        move    #YBgSv0,n2              ; load a with BgSv[r2] (48 bits)
        nop
        move    x:(r2+n),a0
        nop
        move    #YBgSv1,n2
        nop
        move    x:(r2+n),a
        sub     a,b   #YIntruder1,n2    ; b = StSv - BgSv
                                        ; n2 points to base of Intruder table
        abs     b                       ; b = Abs(StSv-BgSv)
        move    b1,x:(r2+n)             ; saved in Intruder table element r2


;   Calculate Bgn
;   On entry b  = abs(Intruder) 48 bits

]Bgn
        clr     a   #YBgn1,n2           ; load a with previous Bgn[r2] (48 bits)
        move    y:YBgnA,y0
        move    x:(r2+n),a1
        move    #YBgn0,n2
        move    a1,x0
        move    x:(r2+n),a0
        mac     -x0,y0,a
        move    b1,x0
        mac     x0,y0,a
        move    a0,x:(r2+n)             ; save Bgn[r1] 24 bits
        move    #YBgn1,n2
        nop
        move    a1,x:(r2+n)

;   Preserve the LUT offset (incremented) for next IRQA
        move    #15,m2                  ; set r2 to modulo 16
        nop                             ; register contents not available (m2?)
        move    y:(r2)+,x0              ; modulo 16 increment of r2
        move    r2,y:YLutOffset         ; new reference pointer saved
        move    #$ffff,m2               ; r2 is no longer modulo 16

;   LUT Sync
;   The StSv BgSv calculation loop issued and extra conversion command for
;   channel 16!

        movep   x:<<SSIDataRegister,a1  ; read current sync value
        move    a1,x:YNewSyncValue
```

```
; fetch t-1 sync channel value
  jclr   #23,x:YOldSyncValue,UpdateOldSyncValue
                                ; was it high? -> not interested
                                ; bit 23 set -> OldSync is hi
                                ; only interested when low
                                ; has a positive edge been detected?

; at this point the last sync reading was low - waiting for hi
 jset #23,x:YNewSyncValue,UpdateOldSyncValue
                                ; bit 23 clr  new Sync value is low also
                                ; not interested


]SyncLut                         ; bit 23 was set and OldSyncValue was clr
;      bclr   #0,x:<<PortBDataRegister  ; Sync pulse for cro - low
       move    #0,x0
       move    x0,y:YLutOffset      ; set LutOffset to 0

]UpdateOldSyncValue
;      bset   #0,x:<<PortBDataRegister  ; Sync pulse for cro - high
; Be warned - the use of the green led line as a sync pulse indicator for
; the cro causes the led brightness to decrease to the point of just
; visible!
       move    x:YNewSyncValue,a1
       move    a1,x:YOldSyncValue   ; no  - (and after yes) store adc value

]RestoreProcessorState

        move   y:-(r7),b2
        move   y:-(r7),b1
        move   y:-(r7),b0
        move   y:-(r7),a2
        move   y:-(r7),a1
        move   y:-(r7),a0
        move   y:-(r7),y1
        move   y:-(r7),y0
        move   y:-(r7),x1
        move   y:-(r7),x0

        move   y:-(r7),n5
        move   y:-(r7),n4
        move   y:-(r7),n3
        move   y:-(r7),n2
        move   y:-(r7),n1

        move   y:-(r7),r5
        move   y:-(r7),r4
        move   y:-(r7),r3
        move   y:-(r7),r2
        move   y:-(r7),r1

        bset   #4,x:<<PortBDataRegister      ; disable adc
        rti                          ; return from IRQA handler

%/
```

We claim:

1. An infrared intrusion sensor comprising:

a detector, including an infrared detector array, adapted to provide a signal indicative of infrared radiation impinging upon the detector;

infrared collection optics adapted to collect and direct infrared radiation to the detector array;

dither means adapted to repetitively scan the infrared radiation across the detector array;

signal processing means adapted to analyse the detector signal and produce output alarm signals; and output display means adapted to display the output alarm signals;

said detector being a heterodyne detector with a local oscillator signal being the scanning frequency of the dither means.

2. The infrared intrusion sensor of claim 1 wherein the infrared detector array comprises a focal plane array of metal film bolometer detectors.

3. The infrared intrusion sensor of claim 1 wherein the optics comprise an infrared transmitting entrance window and Cassegrain-style objective telescope formed by a primary mirror and a secondary mirror wherein the secondary mirror is mounted on the dither means.

4. The infrared intrusion sensor of claim 1 wherein the optics comprise an infrared transmitting entrance window having a hard carbon coating on an outer surface adapted to provide protection against scratching or other damage and an anti-reflection coating on an inner surface and a Cassegrain-style objective telescope.

5. The infrared intrusion sensor of claim 1 wherein the optics comprise an infrared transmitting entrance window, Cassegrain-style objective telescope and a correction lens between the Gassegrain-style telescope and the infrared detector array.

6. The infrared intrusion sensor of claim 1 wherein the dither means is a focal plane scanning device having a mirror pivoted to nod driven by at least one of a pair of piezoceramic drive elements arranged generally parallel to the plane of the mirror.

7. The infrared intrusion sensor of claim 1 wherein the signal processing means is comprised of:

an analogue-to-digital converter adapted to convert analogue signals received from the detector to digital signals;

memory means adapted to provide storage of information; and a digital signal processing module adapted to process the digital signals to produce output alarm signals.

8. The infrared intrusion sensor of claim 1 wherein the signal processing means is comprised of:

an analogue-to-digital converter adapted to convert analogue signals received from the detector to digital signals;

memory means adapted to provide storage of information; and a digital signal processing module adapted to process digital signals from the analogue-to-digital converter and produce output alarm signals wherein the output alarm signals are one or more of:

Target detection

Target direction of movement;

Near/far field indication;

Sensor identification;

Detection probability.

9. An infrared intrusion sensor comprising:

a detector, including an infrared detector array, adapted to provide a signal indicative of infrared radiation impinging upon the detector;

infrared collection optics adapted to collect and direct infrared radiation to the detector array;

dither means adapted to repetitively scan the infrared radiation across the detector array;

signal processing means adapted to analyse the detector signal and produce output alarm signals; and output display means adapted to display the output alarm signals;

wherein the signal processing means is comprised of:

an analogue-to-digital converter adapted to convert analogue signals received from the detector to digital signals;

memory means adapted to provide storage of information; and a digital signal processing module adapted to process the digital signals to produce output alarm signals;

said digital signal processing module consisting of a processor means and a program memory means and being adapted to perform digital signal processing comprising the steps of:

integration over time to produce a background signal;

phase sensitive detection to produce a target signal;

comparison between the target signal and the background signal to produce a difference signal;

a second integration over time to produce a background noise signal;

processing of the background noise signal to produce a threshold signal; and comparison of the difference signal with the threshold signal to produce an alarm signal.

10. The infrared intrusion sensor of claim 9 wherein the target signal is derived from the detector signal by phase sensitive detection at the scanning frequency of the dither means.

11. The infrared intrusion sensor of claim 9 wherein processing of the background noise signal to produce a threshold signal consists of multiplying the background noise signal by an alarm threshold factor.

12. A method of signal processing of signals within an infrared intrusion sensor comprising the steps of:

generating analogue signals indicative of infrared radiation impinging on an infrared detector array;

converting the analogue signals to digital signals;

integrating the digital signals over time to produce a background signal;

producing a target signal by phase sensitive detection of the digital signal;

comparing the target signal and the background signal to produce a difference signal;

integrating the difference signal over time to produce a background noise signal;

processing of the background noise signal to produce a threshold signal; and comparing of the difference signal with the threshold signal to produce an alarm signal.

13. A wide area surveillance apparatus comprising:

a plurality of infrared intrusion sensors each sensor comprising:

a detector, including an infrared detector array, adapted to provide a signal indicative of infrared radiation impinging upon the detector;

infrared collection optics adapted to collect and direct infrared radiation to the detector array;

dither means adapted to repetitively scan the infrared radiation across the detector array;

signal processing means adapted to analyse the detector signal and produce output alarm signals;

said detector being a heterodyne detector with a local oscillator signal being the scanning frequency of the dither means;

network control means adapted to receive output alarm signals from each sensor; and network display means adapted to display the output alarm signals.

14. The apparatus of claim 13 wilerein the network control means includes communication means in the form of a radio frequency link between each sensor and the network control means.

15. The apparatus of claim 13 wherein the network control means comprises a computer and a network controller adapted to interface between the plurality of infrared intrusion sensors and the computer.

* * * * *